United States Patent [19]

North

[11] 3,947,270

[45] Mar. 30, 1976

[54] REPRODUCING APPARATUS AND PROCESS FOR DUPLEX IMAGING IN A SINGLE PASS

[75] Inventor: Arthur J. North, Rochester, N.Y.

[73] Assignee: Xerox Corporation, Stamford, Conn.

[22] Filed: Nov. 1, 1973

[21] Appl. No.: 411,996

[52] U.S. Cl. ..... 96/1.4; 355/3 R

[51] Int. Cl.[2] ..... G03G 13/14

[58] Field of Search ..... 96/1.4; 355/3 R

[56] References Cited

UNITED STATES PATENTS

| | | | |
|---|---|---|---|
| 3,409,356 | 11/1968 | Robertson et al. | 355/3 |
| 3,687,541 | 8/1972 | Aser et al. | 96/1.4 |
| 3,697,170 | 10/1972 | Bhagat et al. | 96/1.4 |

*Primary Examiner*—Norman G. Torchin
*Assistant Examiner*—Judson R. Hightower
*Attorney, Agent, or Firm*—Paul Weinstein; Clarence A. Green; James J. Ralabate

[57] ABSTRACT

A reproduction apparatus for forming an image on a first and an opposing side of a copy sheet in a single pass including a moving photosensitive surface, a means for forming a first image on a first portion of the photosensitive surface and a second image on a second portion of the photosensitive surface, and means for transferring the first image and the second image to the first and the opposing side respectively of a copy sheet in a single pass of the copy sheet to the imaging surface. Preferably, the transferring means includes means for securing the trailing edge of the sheet to the imaging surface and means for pivoting the sheet about the surface. A process of duplex imaging in a single pass is also provided.

15 Claims, 8 Drawing Figures

REPRODUCING APPARATUS AND PROCESS FOR DUPLEX IMAGING IN A SINGLE PASS

BACKGROUND OF THE INVENTION

This invention relates to a reproducing machine for imaging a first and an opposing side of a copy sheet in a single pass to an imaging surface.

A wide variety of reproducing machines using an electrostatographic process have been developed which are capable of forming images on both sides of a copy sheet. This process is commonly referred to in the art as duplexing. Illustrative of these machines are those set forth in U.S. Pat. Nos. 3,227,444; 3,318,212; 3,506,347; 3,580,670; 3,615,129; 3,645,615, and 3,672,765.

In prior art, duplexing type reproducing machines, it has generally been necessary to feed the copy sheet twice to the imaging means in order to transfer an image to the first and the opposing side of the copy sheet. This type of a duplexing process reduces the speed of the reproducing machine because of the necessity of storing the copy sheet after the first image has been transferred and then re-feeding the copy sheet to transfer the second image. It is also generally necessary to re-register the sheet prior to transfer of the second image. Other difficulties which arise with the prior art machines include the necessity of specially organizing originals for copying.

SUMMARY OF THE INVENTION

In accordance with this invention a reproducing apparatus is provided which is adapted to image both sides of a sheet of final support material in a single pass of the sheet to an imaging surface. Namely, in accordance with this invention the sheet is fed in timed relationship to a moving imaging surface a single time in order to transfer images to both sides of the sheet. Therefore, only a single sheet feeding and registration cycle is required and originals may be copied in the order in which they were originally presented.

The apparatus includes a moving imaging surface which is preferably in the form of a drum. Means are provided for forming a first image on a first portion of the imaging surface and a second image on a second portion of the imaging surface, preferably in sequence around the drum surface. Means are also provided for transferring the first image and the second image to the first and the opposing sides of the final support sheet in a single pass of the sheet to the imaging surface. The transferring means preferably includes a means for securing the trailing edge of the sheet to the drum preferably in a pivotable fashion, and means for pivoting the sheet about the imaging surface.

Preferably the moving imaging surface comprises a photosensitive surface and more preferably a photoconductive surface. Preferably, the apparatus includes means for fusing the first and second images to the first and opposing side of the final support sheet. Preferably, the image forming means comprises means for charging the photoconductive surface, means for simultaneously exposing the photoconductive surface to said first and said second images to form corresponding latent electrostatic images, the exposure taking place at spaced points about the surface and means for developing the first and second latent electrostatic images.

In accordance with this invention a process of single pass duplexing is also provided including the steps of providing a moving imaging surface, forming a first image on a first portion of its surface and a second image on a second portion of the surface, and transferring the first image and the second image to a first and an opposing side respectively of a final support sheet in a single pass of the sheet to the imaging surface.

Therefore, it is an object of this invention to provide a reproducing apparatus for imaging a first and an opposing side of a final support sheet in a single pass of the sheet to an imaging surface.

It is a further object of this invention to provide an apparatus as above wherein the sheet is secured to and pivoted about an imaging surface.

It is a further object of this invention to provide a process for including transferring a first and second image to the first and opposing side of a copy sheet in a single pass of the sheet to an imaging surface.

It is a further object of this invention to provide a process as above wherein the sheet is secured to and pivoted about an imaging surface to transfer the first and second images thereto.

These and other objects will become more apparent from the following description and drawings in which.

DETAILED DESCRIPTION OF THE PREFERRED EMBODIMENTS

Figure 1:
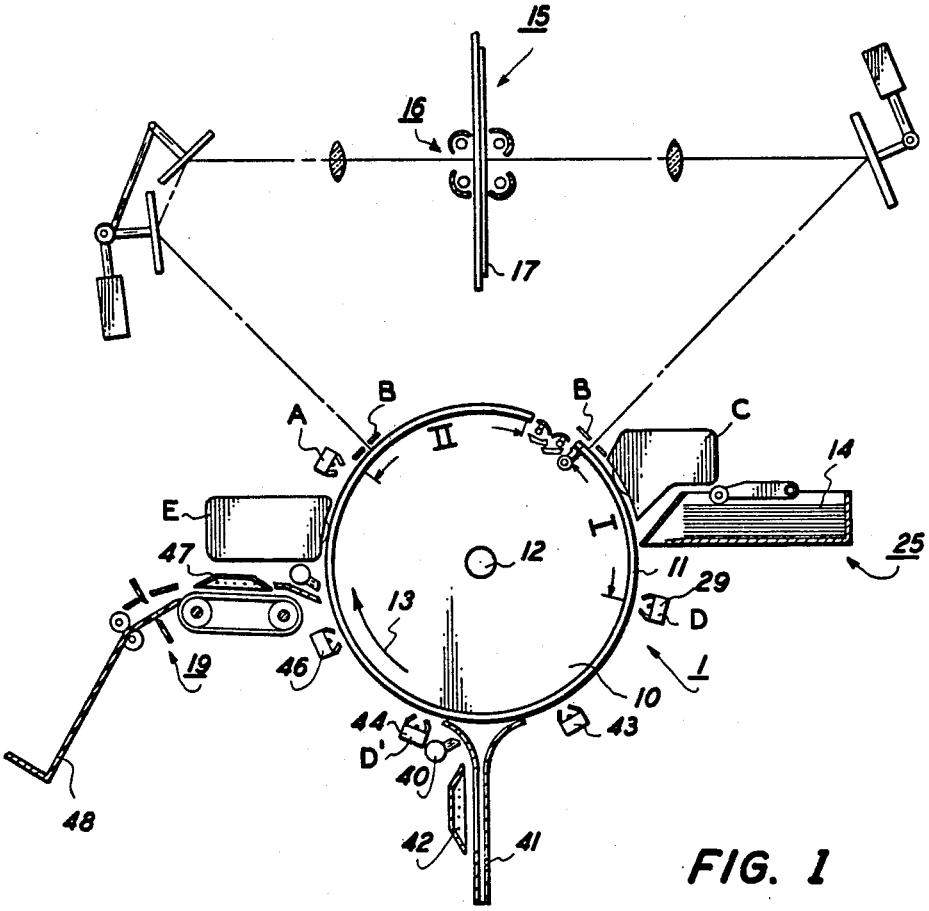
FIG. 1 is a schematic view of an automatic reproducing apparatus in accordance with this invention.

Referring now to FIG. 1, there is shown by way of example, an electrostatographic reproducing apparatus 1 which is adapted to perform duplex copying in a single pass in accordance with the present invention. The reproducing apparatus 1 depicted in FIG. 1 illustrates the various components utilized therein for xerographically reproducing copies from an original. Although the duplexing apparatus of the present invention is particularly well adapted for use with a xerographic reproducing process, it should become evident from the following description that it is equally well suited for use with a wide variety of processing systems including other electrostatographic systems and it is not necessarily limited in its application to the particular embodiment or embodiments shown herein.

The reproducing apparatus illustrated in FIG. 1 employs an image recording drum-like member 10, the outer periphery of which is coated with a suitable photosensitive material 11. One type of suitable photosensitive material comprises the photoconductor disclosed in U.S. Pat. No. 2,970,906, issued to Bixby in 1961. The drum 10 is suitably journaled for rotation within a machine frame (not shown) by means of a shaft 12 and rotates in the direction indicated by arrow 13 to bring the image retaining surface thereon past a plurality of xerographic processing stations. Suitable drive means (not shown) are provided to power and coordinate the motion of the various cooperating machine components whereby a faithful reproduction of the original input scene information is recorded upon a sheet 14 of final support material such as paper or the like.

The practice of xerography is well known in the art and is the subject of numerous patents and texts including Electrophotography by Schaffert, published in 1965, and Xerography and Related Processes by Dessauer and Clark, published in 1965. The various processing stations for producing a copy of an original are herein represented in FIG. 1 as stations A to E. Initially, the drum 10 moves photoconductive surface 11 through charging station A. In charging station A an electrostatic charge is placed uniformly over the photoconductor surface 11 of the drum 10 preparatory to imaging. The charging may be provided by a corona generating device of the type described in U.S. Pat. No. 2,836,725 issued to Vyverberg in 1958.

Thereafter, the drum 10 is rotated to exposure station B. The exposure means 15 at the exposure station is adapted to form a first latent electrostatic image I on a first portion of the photoconductor surface 11 and a second latent electrostatic image II on a second portion of the photoconductor surface. The images I and II are spaced sequentially about the photoconductor surface and comprise the images which, after development, are to be transferred to the first and the opposing side of the copy sheet.

Any desired exposure means 15 could be employed for this purpose. Since the formation of a two-sided copy is usually derived from a two-sided original, the exposure means 15 described in U.S. Pat. No. 3,318,212 is particularly well suited for use in accordance with this invention. The exposure means shown therein particularly at FIG. 4, comprises the preferred exposure means 15 for use in accordance with the present invention. As shown in FIG. 1, the exposure means 15 includes a means 16 for scanning simultaneously both sides of the original 17 and for projecting the respective images to the drum simultaneously at points spaced along the drum surface 11. The exposure means 15 exposes the photoconductive surface 11 to light images of the original input scenes whereby the charge is selectively dissipated in the light exposed regions to record the original input scenes in the form of latent electrostatic images I and II.

After exposure, drum 10 rotates the electrostatic latent images I and II recorded on the photoconductive surface 11 to a development station C wherein a conventional developer mix is applied to the photoconductor surface 11 of the drum 10 rendering the latent images I and II visible. A suitable development station is disclosed in U.S. Pat. No. 3,707,947, issued to Reichart, in 1973. The patent describes a magnetic brush development system utilizing a magnetizable developer mix having carrier granules and a toner colorant. The developer mix is continuously brought through a directional flux field to form a brush thereof. The electrostatic latent images I and II recorded on the photoconductive surface 11 are developed by bringing the brush of developer mix into contact with them.

The developed images I and II on the photoconductive surface 11 are then brought into contact with the sheet 14 of final support material within transfer stations D and D′ respectively, and the toner images I and II are transferred from the photoconductive surface 11 to the contacting side of the final support sheet 14. The final support material may be paper, plastic, etc., as desired. After the toner images I and II have been transferred to the sheet of final support material 14, they are fixed by being advanced through a suitable fusers 42 and 47 which coalesce the transferred images thereto. One type of suitable fuser is described in U.S. Pat. No. 2,701,765, issued to Codichini et al in 1955. After the fusing process, the sheet 14 is advanced to catch tray 16 for subsequent removal therefrom by the machine operator.

Although a preponderance of the toner powder is transferred to the final support sheet 14, invariably some residual toner remains on the photoconductive surface 11 after the transfer of the toner powder images I and II to the final support material. The residual toner particles remaining on the photoconductive surface 11 after the transfer operation are removed from the drum 10 as it moves through cleaning station E. The toner particles may be removed from the photoconductive surface by any conventional means as, for example, the use of a brush as set forth in U.S. Pat. No. 3,572,923, issued to Fisher in 1971. It is believed that the foregoing description is sufficient for purposes of the present application to illustrate the general operation of an automatic xerographic copier 1.

A duplex copying apparatus in accordance with this invention will now be described in greater detail by reference to FIGS. 1 through 8. The reproducing apparatus in accordance with this invention is adapted to image on both sides of a sheet of final support material in a single pass of the sheet to the imaging surface 11. The term "single pass" as employed in this application, means that the sheet has been fed in timed relationship to a moving imaging surface only one time in order to accomplish image transfer to the first and the opposing side of the sheet. A single sheet feeding and registration sequence from a sheet feeder is required in order to obtain imaging on both sides of the sheet. The term "single pass" as defined herein is meant to be distinguished from an arrangement as in U.S. Pat. No. 3,672,765, wherein the sheet is first fed to the imaging surface for transfer of the first image to the first side of the sheet and then withdrawn from the imaging surface and re-fed to the surface for transfer of another image to the opposing side of the sheet. While the duplexing apparatus of that patent accomplishes copying on the first and opposing sides of the sheet in one pass of the sheet through the machine, it does not accomplish that result with a single pass of the sheet to the imaging surface.

The apparatus 1 in accordance with this invention includes a moving imaging surface 11 which is preferably in the form of a drum 10. Means B are provided for forming a first image I on a first portion of the imaging surface 11 and a second image II on a second portion of the imaging surface, preferably in sequence around the drum surface. Most preferably the images I and II are formed simultaneously as suggested in U.S. Pat. No. 3,318,212, described above. Means are also provided for transferring the first image I and the second image II to the first 20 and the opposing sides 21 of the final support sheet 14 in a single pass of the sheet to the imaging surface 11. The transferring means preferably includes a means for securing the trailing edge of the sheet 14 to the drum 10 most preferably in a pivotable fashion and means for pivoting the sheet about the imaging surface.

Figure 2:
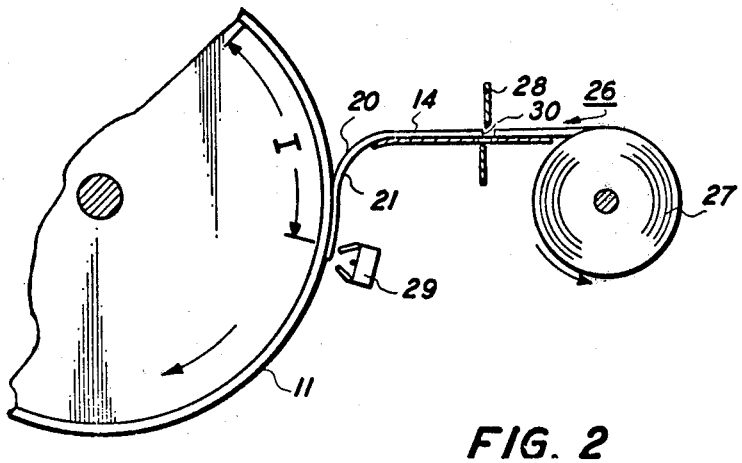
FIG. 2 is a partial schematic view of an alternate sheet feed mechanism for the apparatus of FIG. 1.

Referring to FIG. 1, the means 25 for feeding the sheets 14 to the photoconductive surface 11 of drum 10 may comprise any desired conventional sheet feed and registration mechanism such as that described in U.S. Pat. No. 3,645,615. In the apparatus 1 of FIG. 1, the sheet feed mechanism 25 comprises a mechanism for feeding individual sheets 14 from a stack. Alternatively, if desired, as shown in FIG. 2, the sheets 14 may be fed from a roll feed mechanism 26 such as that described in U.S. Pat. No. 3,639,053 which includes a roll of sheet material 27 and a mechanism for cutting the sheet material to size, such as shears 28, and an appropriate registration mechanism.

Since the sheets are to be secured to the moving photoconductive surface 11 by an appropriate mechanism, as will be described hereinafter, it is apparent that a trail edge deletion could result thereby. Therefore, in accordance with the preferred embodiment of this invention, the size of the sheet 14 is selected to be larger than the size of the image which is to be transferred to it in order to avoid deletion. The excess sheet length is removed at a later stage in processing by conventional means 19 as will be described hereinafter.

Figure 3:
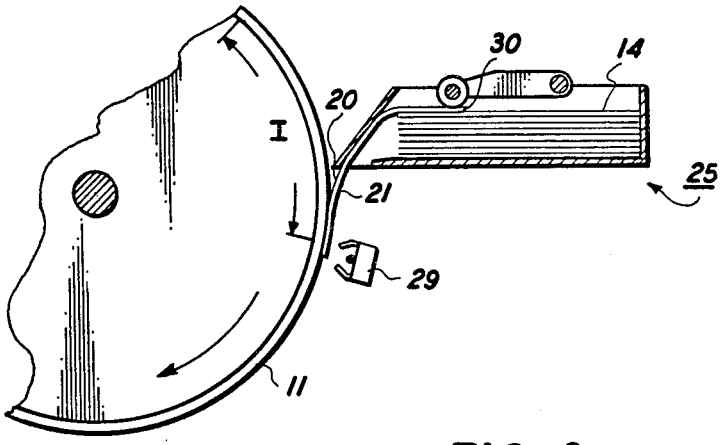
FIG. 3 is a partial schematic view of the apparatus of FIG. 1 during sheet feeding for transferring the first image thereto.

As shown in FIG. 3, the sheet 14 is fed to the drum 10 in an appropriately timed sequence for transfer of the first image I to the first side 20 of the sheet. In the embodiment shown, transfer is accomplished by means of a transfer corona generating device 29 which charges the sheet 14 to attract the toner particles from the photoconducting surface 11 of the drum 10.

Figure 4:
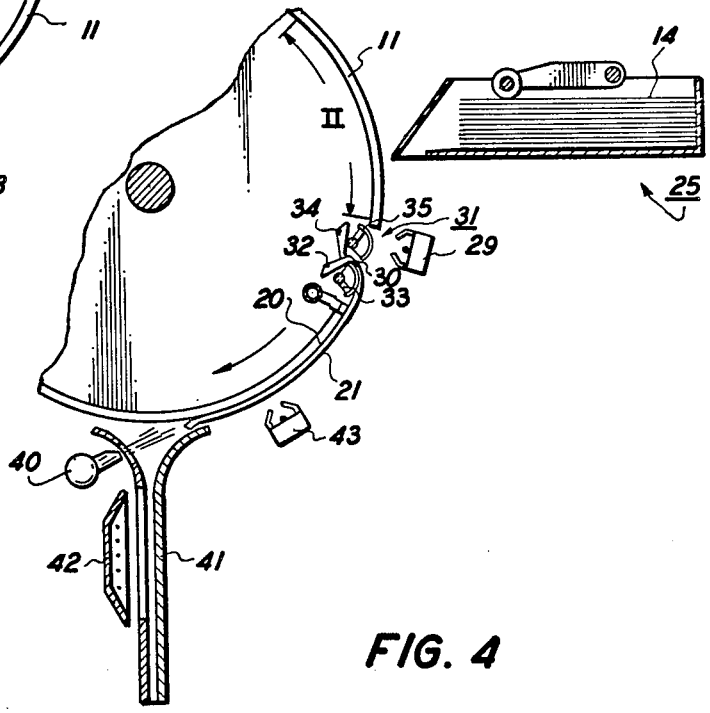
FIG. 4 is a partial schematic view of the apparatus of FIG. 1 during stripping of the sheet after first image transfer.

As the trailing edge 30 of the sheet 14 contacts the drum surface 11, it is pviotably secured thereto by means of tumbling grippers 31 as shown in FIG. 4.

Figure 5:
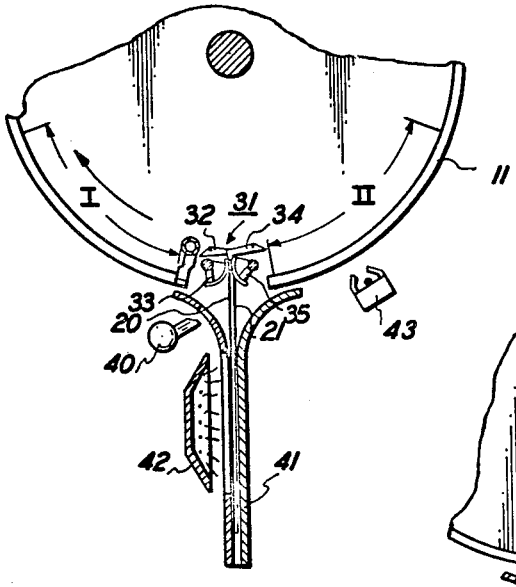
FIG. 5 is a partial schematic view of the apparatus of FIG. 1 during fusing of the first image.
Figure 6:
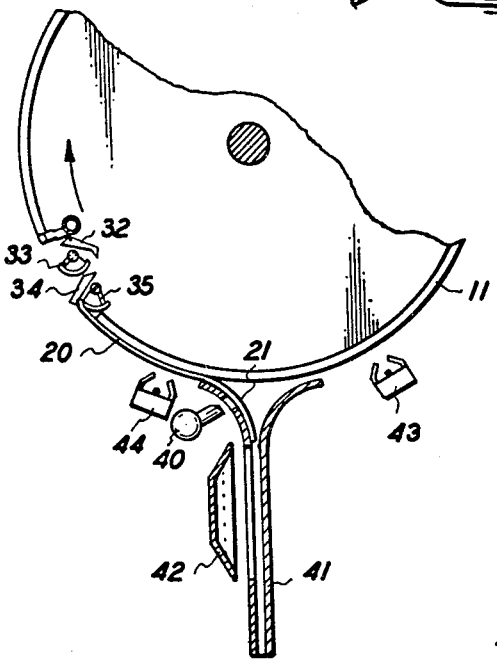
FIG. 6 is a partial schematic view of the apparatus of FIG. 1 showing transfer of the second image of the copy sheet.

The tumbling grippers 31 shown schematically in FIG. 4 are of the type described in greater detail in U.S. Pat. No. 3,537,391. The use of a tumbling type gripper arrangement in accordance with that patent, is preferred in order to prevent creasing of the trailing portion of the sheet 14. As shown in FIG. 4, the trailing edge 30 is gripped by pivotable gripper fingers 32 and pivotable anvils 33 which comprise a first set. As the drum 10 rotates, as shown in FIG. 5, the first set of grippers 32 and 33 pivot to a central point wherein a second set of grippers 34 and 35 now grip the sheet as well. Referring to FIG. 6, as the drum 10 continues to rotate, the first set of grippers 32 and 33 release the sheet and, the second set of grippers 34 and 35 pivot around and hold the sheet 14 in a turned over orientation at the surface 11 until the sheet is ready to be stripped off the drum as shown in FIG. 7.

Referring again to FIG. 4, the sheet 14 having the first image I transferred thereto is stripped from the drum 10 by any conventional means such as the use of a puffer 40, as shown. A chute 41 extending out radially of the drum axis is provided for guiding the sheet 14 during this first sheet stripping operation. Preferably, in accordance with this invention, a means 42 is provided for fusing the first image I to the sheet 14 such as the radiant fuser shown. To aid in the sheet 14 stripping, a detacking corona generating device 43 is provided for substantially neutralizing the charge on the sheet. After the sheet 14 has been stripped from the surface 11 of the drum 10 containing the first image I, as shown in FIG. 5, it is still maintained pivotably secured to the drum by means of the tumbling grippers 31 previously described. As shown in FIG. 6, continued rotation of the drum 10 causes the opposing side 21 of the sheet 14 to contact the surface 11 of the drum 10 containing the second image II and a corona generating device 44 is provided for charging the sheet for tranferring the second image to the opposing side of the sheet.

Figure 7:
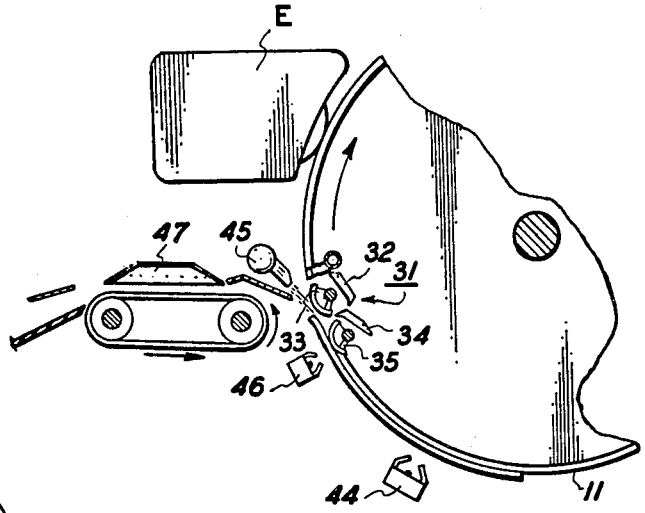
FIG. 7 is a partial schematic view of the apparatus of FIG. 1 showing sheet stripping after transfer of the second image.

Referring to FIG. 7, following transfer of the second image II to the sheet 14, the pivoting grippers 31 release the trailing edge of the sheet, which has now become the leading edge thereof, and the sheet is stripped completely from the drum surface 11 by means of a puffer 45 and detacking corona generating device 46 as in accordance with the previous stripping operation.

Figure 8:
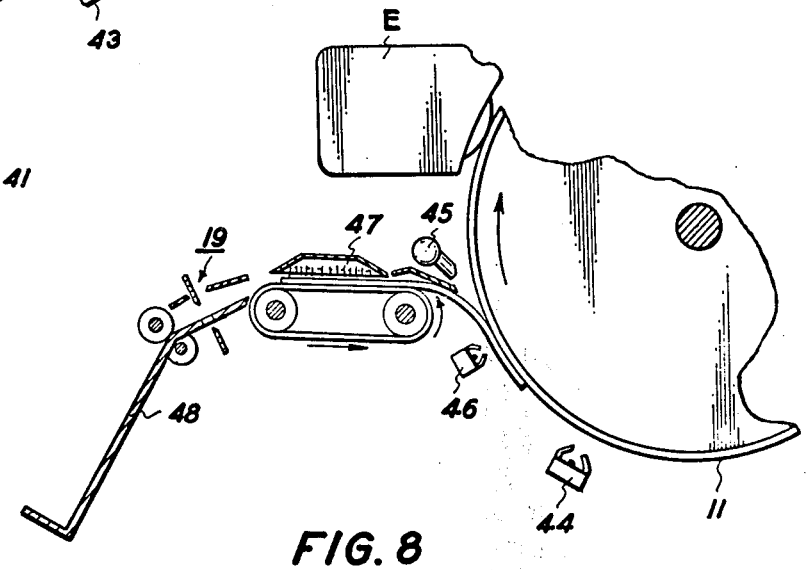
FIG. 8 is a partial schematic view of the apparatus of FIG. 1 showing fusing of the second image.

As shown in FIG. 8, the sheet 14 is then fed off of the drum surface 11 and the second image II is fused thereto by a conventional radiant fuser 47. Following fusing of the second image II, the sheet is fed to suitable output device 48 such as the tray shown. If desired, the output device could comprise a sorter or other known device.

Means 19 are provided between the output of the fuser 47 and the catch tray 48 to trim any excess sheet length which may have been employed to avoid trail edge deletion. The means 19 shown comprises a simple shearing device similar to that described previously with reference to the roll feed mechanism 26.

It will be apparent that it would be desirable to provide seals about the gripping mechanism 31 in order to prevent toner contamination of the interior of the drum 10. Another approach that could be employed would be to use an apparatus to control the magnetic brush in which the magnetic brush is brought out of operative contact with the surface 11 of the drum 10 as the grippers 31 pass by. One such apparatus for moving the brush in and out of operative contact with the surface 11 is described in U.S. Pat. No. 3,572,288. Similarly, if desired, the cleaning mechanism at station E could be retracted from contact with the surface 11 during that period when the gripper mechanism 31 passes by it.

The process in accordance with this invention has already been illustrated in some detail by reference to the apparatus. The process in its broadest sense comprises forming a first image on the first portion of the surface 11 and a second image on a second portion of the surface 11, followed by transferring the first image I and the second image II to the first and the opposing sides of the final support sheet 14 in a single pass of the sheet to the imaging surface 11. Preferably, the transferring step includes the step of securing the sheet 14 to the surface 11 followed by pivoting of the sheet about the surface to accomplish transfer of the images I and II to both sides of the sheet. Preferably, as aforenoted, the images are formed on the surface 11 substantially simultaneously.

While it is preferred in accordance with this invention to form the images I and II simultaneously it is recognized that this approach is not as beneficial for thin originals because the images on the respective reverse sides of the sheet show through. This problem with thin originals may be overcome by biasing the development system so as not to develop the undesired images or by sequentially exposing the first and opposing sides of the original.

The patents and texts referred to specifically in the description of this application are intended to be incorporated by reference into the description.

It is apparent that there has been provided in accordance with this invention a reproducing apparatus and process for duplex imaging in a single pass which fully satisfies the objects, means and advantages set forth hereinbefore. While the invention has been described in conjunction with specific embodiments therefore, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What is claimed is:

1. A reproduction apparatus for forming an image on a first and an opposing side of a copy sheet comprising:

a moving photosensitive surface;

means for forming a first image on a first portion of said photosensitive surface, and a second image on a second portion of said photosensitive surface; and means for transferring sequentially said first image and said second image to a first and opposing side respectively of said copy sheet, said transferring means including means for pivotably securing said sheet at said surface, and means for pivoting said sheet about said surface.

2. An apparatus as in claim 1 wherein said transferring means includes means for feeding said sheet to said surface in a timed relationship a single time in order to accomplish image transfer to said first and opposing sides of said sheet.

3. A reproduction apparatus for forming an image on a first and an opposing side of a copy sheet in a single pass comprising:

a moving photosensitive surface;

means for forming a first image on a first portion of said photosensitive surface, and a second image on a second portion of said photosensitive surface; and means for transferring said first image and said second image to a first and opposing side respectively of said copy sheet in a single pass of said sheet to said surface, said transferring means including means for securing the trailing edge of said sheet to said surface and means for pivoting said sheet about said surface.

4. An apparatus as in claim 3 wherein said securing means is adapted to pivotably secure said trailing edge of said sheet.

5. An apparatus as in claim 4 wherein said image forming means is operative to form said first image and said second image substantially simultaneously.

6. An apparatus as in claim 4 wherein said photosensitive surface comprises a drum.

7. An apparatus as in claim 6 wherein said surface comprises a photoconductive surface.

8. An apparatus as in claim 6 further including means for fixing the transferred images to said sheet.

9. An apparatus as in claim 8 wherein said image forming means includes:

means for forming flowing light images of original input scenes corresponding to said first and said second images, means for projecting said flowing light images on said photoconductive surface to form corresponding latent electrostatic images; and means for developing said latent electrostatic images to form said first and second images.

10. An apparatus as in claim 8 wherein said fixing means comprises:

means for fusing said first image to said sheet following transfer of said first image; and means for fusing said second image to said sheet following transfer of said second image.

11. A process for forming an image on a first and an opposing side of a copy sheet comprising:

providing a moving photosensitive surface;

forming a first image on a first portion of said photosensitive surface, and a second image on a second portion of said photosensitive surface; and transferring sequentially said first image and said second image to a first and an opposing side respectively of said copy sheet, said transferring step including the steps of pivotably securing said copy sheet at said photosensitive surface and pivoting said sheet about said surface following transfer of said first image to said first side of said sheet.

12. A process for forming an image on a first and an opposing side of a copy sheet in a single pass comprising:

providing a moving photosensitive surface;

forming a first image on a first portion of said photosensitive surface and forming a second image on a second portion of said photosensitive surface; and transferring said first image and said second image to a first and an opposing side respectively of said copy sheet in a single pass of said sheet to said surface, said transferring step including the steps of securing the trailing edge of said sheet to said surface and pivoting said sheet about said surface following transfer of said first image to said first side of said sheet.

13. A process as in claim 12 wherein said first and second images are formed substantially simultaneously.

14. A process as in claim 12 further including the step of fixing the transferred images to said sheet.

15. A process as in claim 14 wherein said fixing step comprises fusing said first image to said sheet following transfer of said first image thereto and fusing said second image to said sheet following transfer of said second image thereto.

* * * * *